US005547427A

United States Patent [19]

Rigal et al.

[11] Patent Number: 5,547,427

[45] Date of Patent: Aug. 20, 1996

[54] GOLF CLUB HEAD HAVING A HOLLOW PLASTIC BODY AND A METALLIC SEALING ELEMENT

[75] Inventors: Jean-Pierre Rigal, La Balme-de-Sillingy; Benoît Vincent, Annecy-le-Vieux, both of France

[73] Assignee: Taylor Made Golf Company, Inc., Carlsbad, Calif.

[21] Appl. No.: 313,041

[22] PCT Filed: Feb. 26, 1993

[86] PCT No.: PCT/FR93/00196

§ 371 Date: Sep. 30, 1994

§ 102(e) Date: Sep. 30, 1994

[87] PCT Pub. No.: WO93/19817

PCT Pub. Date: Oct. 14, 1993

[30] Foreign Application Priority Data

Apr. 1, 1992 [FR] France ..... 92/04191

[51] Int. Cl.[6] ..... A63B 53/04

[52] U.S. Cl. ..... 473/345; 473/346; 473/349

[58] Field of Search ..... 273/167 R, 167 A, 273/167 H, 167 F, 170, 171, 172, 173, 174, 79, 78, 193 R, 194 R, 186.2, 187.4; 473/345, 346, 349

[56] References Cited

U.S. PATENT DOCUMENTS

| | | | |
|---|---|---|---|
| 4,021,047 | 5/1977 | Mader | 273/167 H |
| 4,438,931 | 3/1984 | Motomiya | 273/167 H |
| 4,775,447 | 3/1986 | Hariguchi | 273/167 H |
| 4,811,949 | 3/1989 | Kobayashi | 273/171 |
| 4,883,623 | 11/1989 | Nagamoto | 273/167 R |
| 4,930,781 | 6/1990 | Allen | 273/167 F |
| 4,988,104 | 1/1991 | Shiotani et al. | 273/167 H |
| 5,024,437 | 6/1991 | Anderson | 273/78 |
| 5,090,702 | 2/1992 | Viste | 273/167 H |
| 5,106,094 | 4/1992 | Desbiolles | 273/173 |
| 5,141,230 | 8/1992 | Antonious | 273/167 H |

FOREIGN PATENT DOCUMENTS

| | | | |
|---|---|---|---|
| 211781 | 12/1957 | Australia | 273/167 F |
| 22473/77 | 8/1978 | Australia . | |
| 0470488 | 12/1992 | European Pat. Off. . | |
| 61-33973 | 10/1986 | Japan . | |
| 2240480 | 8/1991 | United Kingdom . | |

*Primary Examiner*—Sebastiano Passaniti
*Attorney, Agent, or Firm*—Greenblum & Bernstein P.L.C.

[57] ABSTRACT

The invention is related to a golf club head including a hollow body made of a single molded thermoplastic piece, an opening facing forwardly and including an upper wall, a peripheral wall, and possibly a lower wall. Further included is an impact-resistant metallic sealing element including a front wall forming the impact surface of the club head, attached and cooperating with the body so as to define an inner space. Such a construction improves upon the sensation perceived by the golfer at impact while retaining direct transmission of information to him or her, and it increases the range of possible mass distribution and concentration so as to make the head more tolerant by increasing its moments of inertia.

19 Claims, 4 Drawing Sheets

GOLF CLUB HEAD HAVING A HOLLOW PLASTIC BODY AND A METALLIC SEALING ELEMENT

BACKGROUND OF THE INVENTION

1. Field of the Invention

The present invention is related to a new construction for a golf club head, especially a head of the "wood" type, as well as to the method of manufacturing such a head.

2. Discussion of Background and Material Information

The golf club used typically at the start of a hole is commonly known as the "driver". It generally has a hollow metallic head with a slight thickness and is constituted by the assembly of several metal elements welded to one another to define a closed inner cavity. Such constructions, described in U.S. Pat. No. 4,438,931, U.S. Pat. No. 5,024,437 and Japanese Patent Publication No. 61-33973, for example, result in clubs whose tolerance cannot be improved beyond a certain threshold due to the critical mass of the head and due to the isotropic character of the material. Indeed, generally it is not possible to add weights to the club head without increasing the mass limit beyond a point at which it is no longer possible to obtain the correct balance for the club and, furthermore, the distribution of mass is very closely linked to the shape of the head itself.

Another disadvantage of this type of head is related to the nature of the material that constitutes the impact surface, i.e., the ball-striking face, which, although enabling a direct transmission of information to the player, provides a disagreeable sensation and sound at impact.

Heads constructed entirely of a composite material, with the exception of the sole, have appeared over the last few years. These types of constructions are very rarely favored by professional golfers because, most often, they are constructed in a single piece by the compression molding method, without any particular regard to the distribution of mass.

SUMMARY OF THE INVENTION

It is the object of the present invention to provide a golf club head having a new construction that overcomes the aforementioned disadvantages, i.e., on the one hand, enabling improvement of the sensation perceived by the player at impact, while retaining direct transmission of information to the player, and, on the other hand, increasing the mass distribution and concentration possibilities so that the head becomes more tolerant by increasing its moments of inertia.

Another object of the invention is to improve the transmission of the energy of the mass, so divided and concentrated, directly towards the impact surface. The invention also has the advantage of being able to be implemented by various techniques and in a wide choice of materials.

To this end, the present invention is related to a golf club head that includes, on the one hand, a hollow body made of a single, molded, thermoplastic element, having a forwardly facing opening, including an upper wall, a peripheral wall or belt, and possibly a lower wall and, on the other hand, an impact-resistant metallic sealing element comprising a front wall constituting the impact surface, attached and cooperating with the body so as to define an inner space.

Advantageously, at its periphery, the body comprises at least one peripheral housing within which an additional mass made of a high density material is positioned. In addition, the body comprises one (or several) inner reinforcement wall(s) dividing the inner space into a plurality of cavities.

BRIEF DESCRIPTION OF THE DRAWINGS

The invention will be more fully described and other characteristics and advantages of the invention will become apparent from the description that follows with reference to the annexed drawings that are provided only as non-limiting examples thereof.

DETAILED DESCRIPTION OF THE PREFERRED EMBODIMENTS

Figure 1:
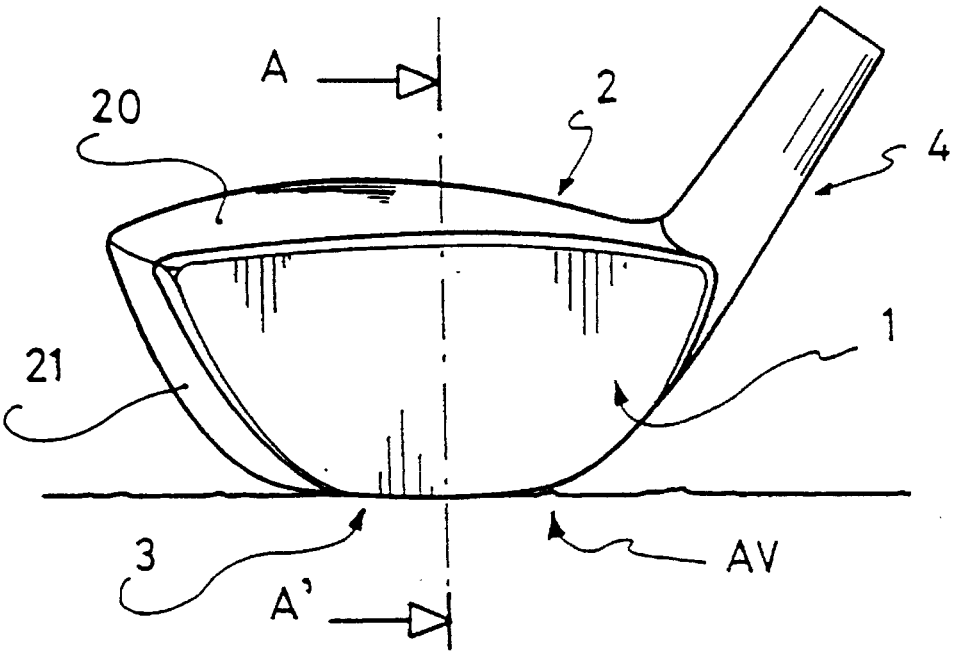
FIG. 1 is a front elevational view of a "wood" type head, and especially a head of the invention.

In FIG. 1, a golf club head according to the invention, especially of the "wood" type, is represented in a front elevational view. The club head has a front portion AV constituting the impact surface 1, a main portion constituting the body 2, a lower portion constituting the sole 3 and, finally, an upper portion extending from the body upwardly, constituting the neck or cavity 4. The body can be arbitrarily sub-divided into two sub-portions, viz., an upper sub-portion or top 20 of the body and a lower sub-portion or bottom 21 of the body.

Figure 2:
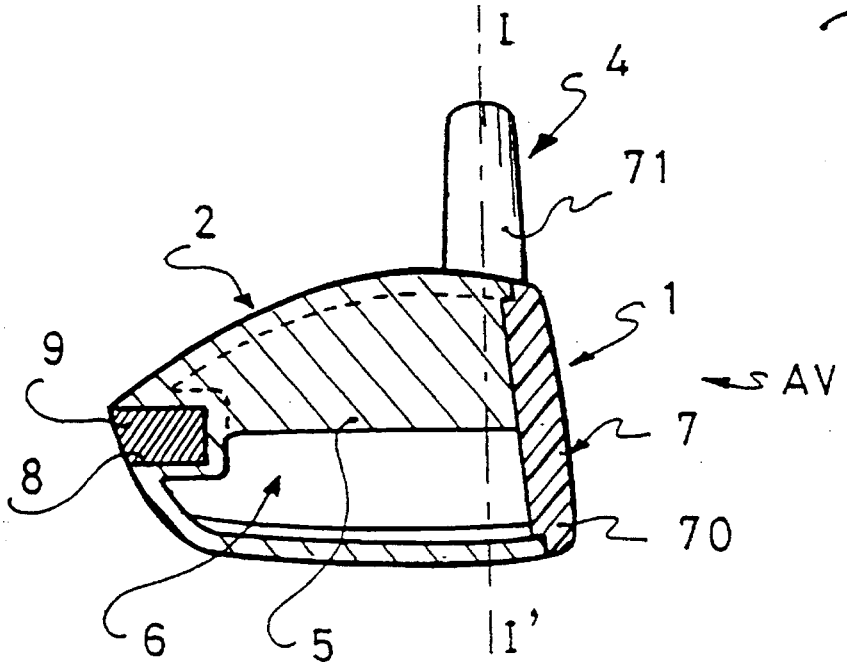
FIG. 2 is a side elevational sectional view along line A–A' of FIG. 1.

As is shown in FIG. 2, the golf club head according to the invention includes several assembled elements. The body 2 is hollow and includes an opening that faces towards the front AV and is constituted by a single element molded from a thermoplastic material.

The body is made of a low density, though rigid material. Its mass can vary from approximately 14 to 39 g. It is made from a molded thermoplastic material, such as polyamide, ABS, polyamide based copolymer, for example.

The modulus of the material as well as the thickness of body 2 must be adequate so as to enable it to resist the compression exerted by the shock of the ball under normal usage conditions. To increase its rigidity, it is provided that the body comprises inner reinforcement walls or ribs 5, as is shown in more detail in FIG. 3.

The body 2 and the inner reinforcement walls 5 are preferably made as a single injection-molded element.

The average thickness e of the peripheral wall of body 2 as well as of its reinforcement walls is comprised approximately between 1.5 and 4 mm. It can also be provided that the body is reinforced by means of short glass or carbon fibers, for example.

Inner space 6 is defined by the assembly of the shell or body 2 and by a sealing element 7 that alone constitutes the impact or striking surface 1 of the head. Such space 6 could also be partially or entirely occupied by a very low density foam, such as polyurethane, for example.

Sealing element 7 has a mass comprised between approximately 45 and 65 g and is made of metal, preferably of steel, titanium, aluminum or an aluminum alloy. The function of sealing element 7 is to resist shocks during the impact of the ball and must therefore have an adequate thickness. In the case of steel, its thickness is comprised approximately between 2.5 and 3 mm. In the case of titanium, the thickness is comprised approximately between 3 and 4 mm. Finally, in the case of aluminum, it is comprised approximately between 4 and 5 mm.

This element can be manufactured by break-mold wax or by forging, especially if steel is used. It can be manufactured by injection or by gravity molding in the case of aluminum.

Figure 3:
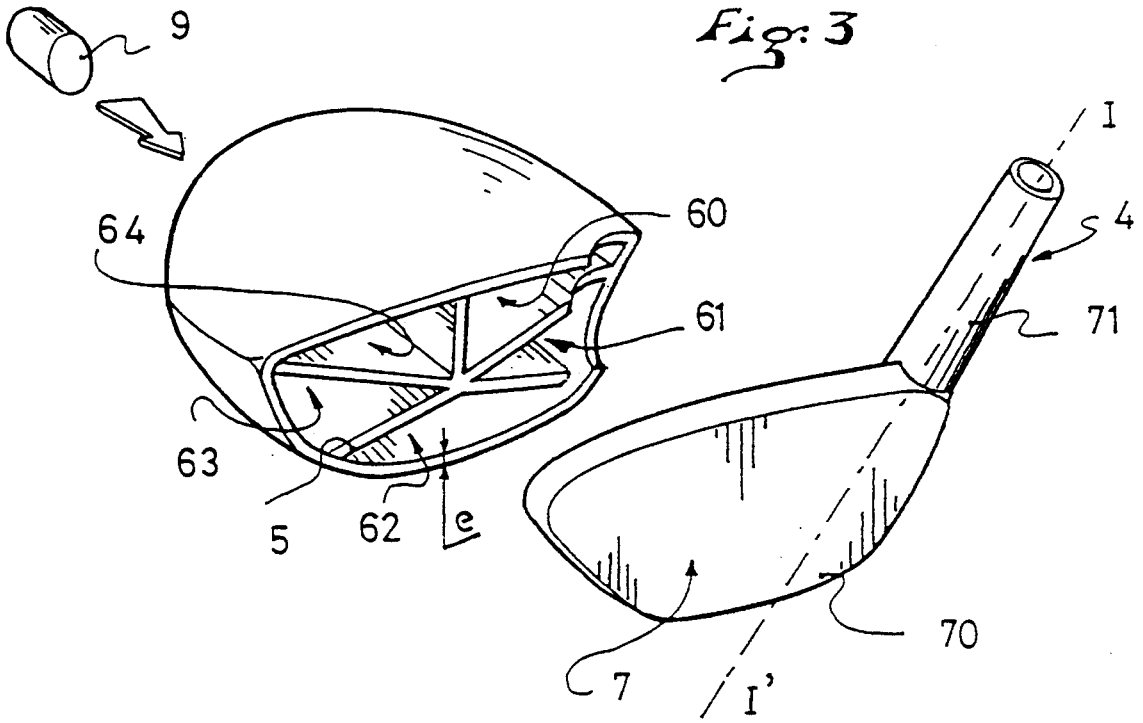
FIG. 3 is a perspective view showing the inner subassembly of the head before assembly of its various component elements.

As is shown in FIG. 3, the sealing element 7 comprises a front wall 70 constituting the impact surface 1 and it extends upwardly and along the side of the impact surface by means of an upper tubular portion 71 constituting the neck, which is adapted to receive the club shaft. Upper portion 71 is offset towards the rear with respect to the impact surface, which means that axis I–I' of the neck is itself offset towards the rear of the impact surface and its extension does not intersect such impact surface. The upper tubular portion 71 of the sealing element 7 can be manufactured separately and then molded thereto.

This special construction of the sealing element described hereinabove has the advantage of directly transmitting information to the hands of the golfer at impact with the ball.

The affixation of the sealing element 7 on the body 2 can be obtained by any means, such as adhesive, screws, rivets or by other means.

As is shown in FIGS. 2 and 3, the body 2 comprises one (or several) housing(s) 8 located at its periphery. Each housing 8 is occupied by an additional mass 9 made of a high-density material and is connected to the inner wall 70 of the sealing element 7 by means of inner reinforcement walls 5. Thus, any deformation of the body is avoided and the energy of mass 9 is transmitted directly to the impact surface without dissipation in the peripheral wall of the shell or body 2.

The additional mass 9 is made in one piece from a heavy metal, such as lead, nickel, copper or others, for example. The density of the material used is preferably greater than 7. It can be force-fitted in the housing, screwed in place or even glued.

One can provide, as an example, a possible mass distribution for a "wood" type club head and for balancing a club with a total length of 43.5 inches (1104.9 mm) at a static moment (measured at 14 inches, or 355.6 mm, from the upper end of the club).

The shaft is of the commercial DYNAMIC GOLD S300 type whose mass is equal to 116 g. The grip has a mass of 50 g.

Balancing requirements impose a head mass limit of 197 g.

The distribution of mass for each element constituting the head, as described above, without consideration of additional mass for balancing, e.g., is as follows:

mass of sealing element (7)=54±10 g, mass of body (2)=36±10 g, foam=10 g approximately, total mass of head=100±20 g.

The available mass increase to obtain proper balancing of the head by means of additional weights for the head is therefore approximately 97 g with boundary values of 77 g and 117 g, which primarily depend on the rigidity and density of the materials used for the various elements of the head.

In the example of FIGS. 2 and 3, the body 2 is provided with inner reinforcement walls 5 that separate the inner space 6 into various cavities 60, 61, 62, 63, 64. It can be provided that each inner wall 5 can have one (or several) orifice(s), not represented, enabling the contiguous cavities to come into contact with one another. Thus during foaming of a filler material in inner space 6, the distribution of the foam can occur normally.

Figure 4:
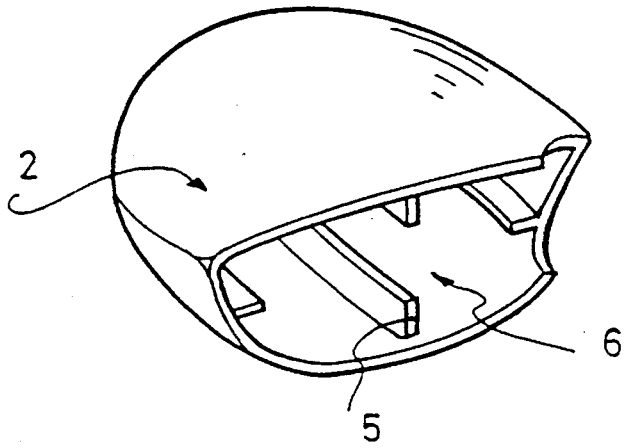
FIG. 4 is a perspective view of the body of the club head according to a variation of FIG. 3.

It can be provided, as is shown in FIG. 4, that the reinforcement walls can be replaced by simple ribs 5 so as to facilitate filling of inner space 6 with foam.

Figure 5:
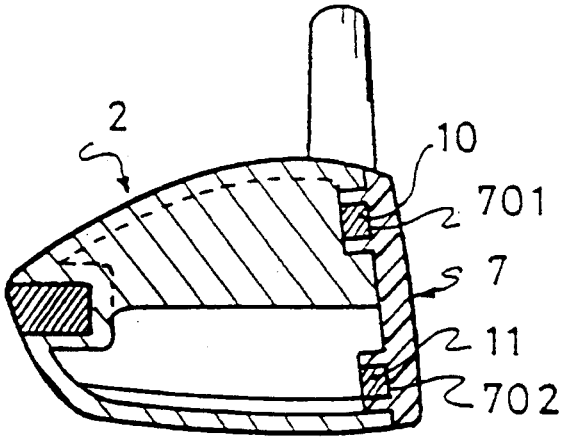
FIG. 5 is a side elevational sectional view along line A–A' of a variation of FIG. 2.

FIG. 5 illustrates a variation of the invention whereby the additional masses 10, 11 are affixed to the sealing element 7 and arranged in housings 701, 702 provided to this end and provided on the surface of element 7.

Such a construction has the advantage of enabling the refinement of the position of the center of gravity and the positions of the axes of inertia of the head.

Figure 6:
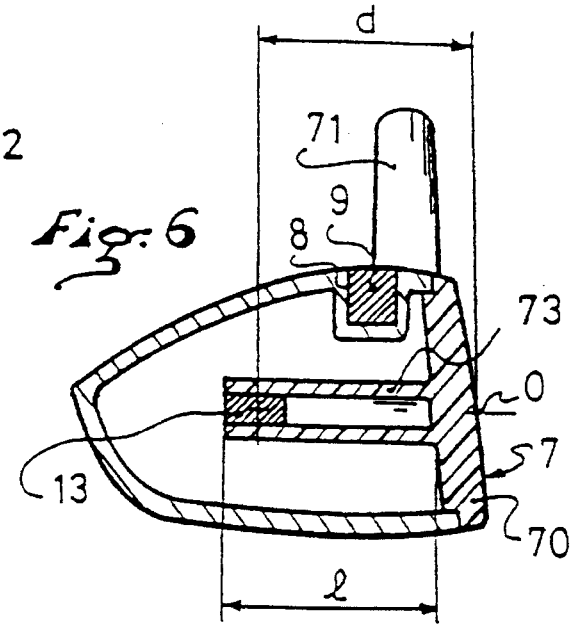
FIG. 6 is a side elevational sectional view along line A–A' of the golf club head of the invention according to another variation.

FIG. 6 illustrates another variation having the same objective as the previous one, by affixing an additional mass 13 to an inner portion 73 of the sealing element 7, the inner portion extending along a length l in the inner space of the body of the club head.

For example, portion 73 can be a hollow tube in which the additional mass 13 is fixed by any means such as welding, soldering, screwing, etc. The longitudinal position of the mass 13 with respect to center O of surface 1, translated by a measured distance d, can be easily adjusted by displacing the mass 13 within tube 73, which will directly influence the position of the center of gravity of the head.

In the case of FIG. 6, as also in the previous examples, one (or several) housing(s) 8 containing additional mass(es) 9 can be provided at any desired point on the peripheral wall of body 2 as, for example, in the vicinity of the periphery of the front wall 70 of the sealing element 7.

Figure 7:
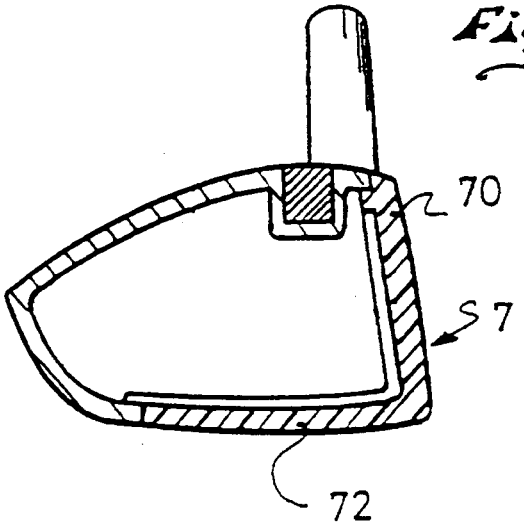
FIGS. 7 and 8 are side elevational sectional views along line A–A' of the golf club head according to two further variations.

FIG. 7 shows a variation wherein the sealing element 7 includes a lower portion 72 constituting the actual sole of the head. Such a construction has the advantage of improving the abrasion resistance of the sole.

Figure 8:
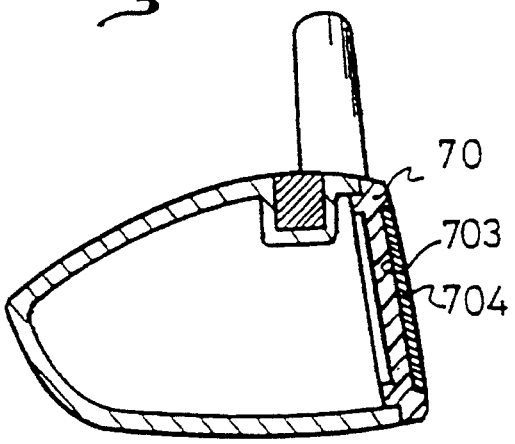

FIG. 8 shows a variation wherein the front wall 70 of the sealing element comprises an external recess or housing 703, in which is located an insert 704 made of a composite material, such as ceramic or plastic, so as to improve the sensation perceived by the golfer at impact with the ball, while at the same time retaining adequate surface rigidity and resistance.

Figure 9:
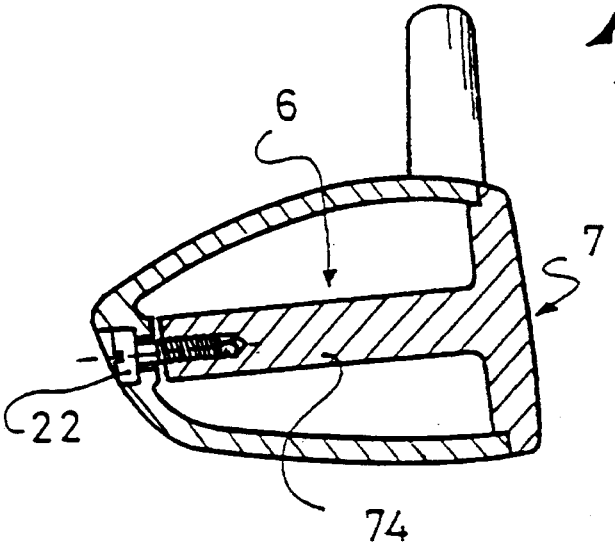
FIGS. 9 and 10 are side elevational sectional views along line A–A' of the golf club head according to two still further variations.

FIG. 9 illustrates a variation whereby the sealing element 7 is extended by a central rod 74 crossing the inner cavity 6 and is connected to the hollow body 2 by means of a screw 22. The screw can be selected from a high density material such as nickel, copper or other, and can constitute the additional mass. The advantage of this embodiment is that it provides a simple and efficient solution to the affixation method of sealing element 7 onto body 2.

Figure 10:
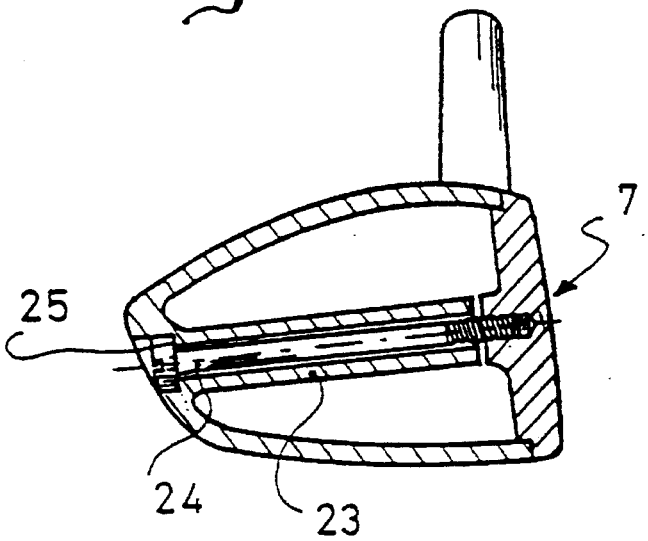

FIG. 10 shows a possible variation, whereby the body 2 has the hollow central rod 23, in which a screw 24 of a longer length is guided, in abutment on a circular shoulder 25 of the body and connects body 2 to the sealing element 7.

Figure 11:
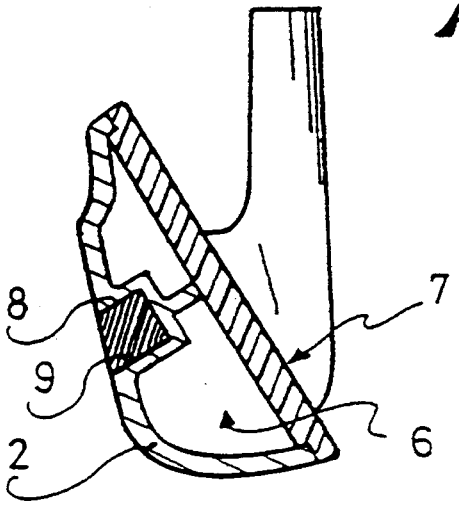
FIG. 11 is a side elevational sectional view of an "iron" type head according to the invention.

The invention can also apply to the "iron" type of golf club head as is shown in FIG. 11. The inner space 6 defined by the assembly of the body 2 and the sealing element 7 is smaller than in the case of a "wood" type of head, but the principle of construction remains identical for each of the variations described previously.

Naturally, the invention is not limited to the embodiments described and represented as examples hereinabove, and also comprises all technical equivalents and combinations thereof.

We claim:

1. A golf club head comprising:

a hollow body made of a single piece, said hollow body comprising an upper wall and a peripheral wall;

an impact-resistant metallic sealing element, said sealing element comprising a shock-resistant front wall, said front wall comprising a ball-striking surface, said sealing element cooperating with said hollow body to define an inner space;

said hollow body being molded in thermoplastic and comprising, at a periphery of said hollow body, at least one housing, said housing having therewithin an additional mass made of a high-density material; and said sealing element comprises an upper tubular portion extending to form a neck of said golf club head and being adapted to have force-fitted therein a golf club shaft.

2. A golf club head according to claim 1, wherein:

said single piece hollow body further comprises a lower wall.

3. A golf club head according to claim 1, wherein:

said hollow body comprises at least one inner reinforcement wall.

4. A golf club head according to claim 1, wherein:

said hollow body comprises a plurality of inner reinforcement walls.

5. A golf club head according to claim 1, wherein:

said hollow body has a thickness comprised between 1.5 mm and 4 mm.

6. A golf club head according to claim 1, wherein:

said sealing element is a molded or forged element.

7. A golf club head according to claim 6, wherein:

said sealing element is made of steel.

8. A golf club head according to claim 7, wherein:

said sealing element has a thickness comprised between 2.5 mm and 3 mm.

9. A golf club head according to claim 1, wherein:

said sealing element is made of metal by gravity molding or injection molding.

10. A golf club head according to claim 9, wherein:

said sealing element is made of aluminum or an aluminum alloy.

11. A golf club head according to claim 10, wherein:

said sealing element has a thickness comprised between 4 mm and 5 mm.

12. A golf club head according to claim 1, wherein:

said sealing element comprises an inner portion extending rearwardly from said sealing element along a predeterminate length; and an additional mass is affixed to said inner portion of said sealing element.

13. A golf club head according to claim 1, further comprising:

a plurality of additional masses; and a plurality of housings affixed to a rearwardly facing surface of said sealing element for housing respective ones of said plurality of masses.

14. A golf club head according to claim 1, wherein:

said sealing element further comprises a lower portion constituting a sole of said golf club head.

15. A golf club head according to claim 1, wherein:

said front wall of said sealing element comprises a recess facing externally of said golf club head;

an insert positioned within said recess, said insert being made of a composite material.

16. A golf club head according to claim 15, wherein:

said composite material comprises ceramic.

17. A golf club head according to claim 15, wherein:

said composite material comprises plastic.

18. A golf club head according to claim 1, wherein:

said golf club head is a wood type.

19. A golf club head according to claim 1, wherein:

said golf club head is an iron type.

* * * * *